United States Patent [19]

Naito

[11] 3,975,897

[45] Aug. 24, 1976

[54] ELECTRONIC DISPLAY DIGITAL WRISTWATCH

[75] Inventor: Okito Naito, Suwa, Japan

[73] Assignee: Kabushiki Kaisha Suwa Seikosha, Tokyo, Japan

[22] Filed: Jan. 30, 1975

[21] Appl. No.: 545,654

[30] Foreign Application Priority Data

Jan. 30, 1974 Japan ..... 49-12438

[52] U.S. Cl. ..... 58/23 R; 58/85.5

[51] Int. Cl.[2] ..... G04C 3/00; G04B 19/30

[58] Field of Search ..... 58/23 R, 50 R, 85.5; 328/14

[56] References Cited

UNITED STATES PATENTS

| | | | |
|---|---|---|---|
| 3,733,803 | 5/1973 | Hiraga et al. | 58/85.5 X |
| 3,810,356 | 5/1974 | Fujita | 58/23 R |
| 3,852,952 | 12/1974 | Yittoz et al. | 58/85.5 X |

*Primary Examiner*—Edith Simmons Jackmon

*Attorney, Agent, or Firm*—Blum, Moscovitz, Friedman & Kaplan

[57] ABSTRACT

An electronic digital display wristwatch wherein correction of the time displayed is facilitated by an improved manually operated correction assembly. The electronic wristwatch includes a divider circuit comprising a plurality of divider stages adapted to produce timekeeping signals in response to a high frequency time standard signal applied to said divider circuit. A plurality of display elements are adapted to receive the timekeeping signals and display time in response thereto. A correction circuit assembly is coupled to each of the respective divider stages producing timekeeping signals. The correction circuit assembly includes a manually operated member displaceable in a first and second direction, the displacement of the member in a first direction effecting selection of a divider stage to be corrected, and displacement of said member in the other direction effecting correction of the divider stage selected by the first mentioned displacement.

13 Claims, 6 Drawing Figures

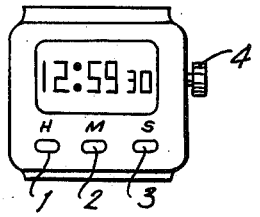
FIG. 1
PRIOR ART
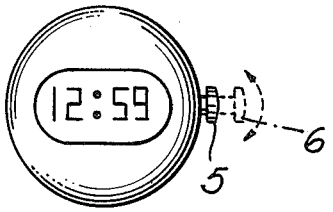
FIG. 2
PRIOR ART
FIG. 3
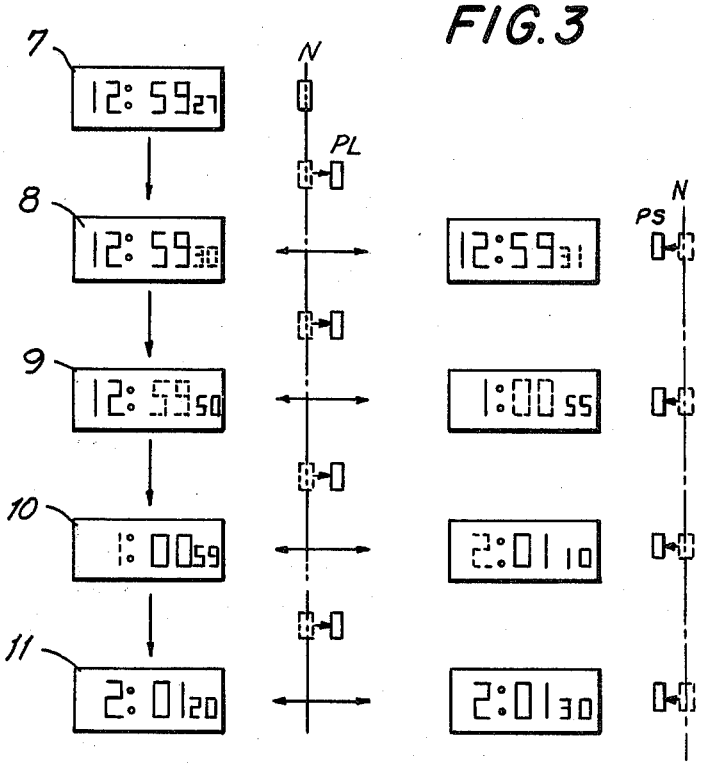

| $Q_1$ | $Q_2$ | R | S | M | H |
|---|---|---|---|---|---|
| 0 | 0 | 1 | 0 | 0 | 0 |
| 1 | 0 | 0 | 1 | 0 | 0 |
| 0 | 1 | 0 | 0 | 1 | 0 |
| 1 | 1 | 0 | 0 | 0 | 1 |

ELECTRONIC DISPLAY DIGITAL WRISTWATCH

BACKGROUND OF THE INVENTION

This invention is directed to an electronic digital display wristwatch and in particular to the correction of the time digitally displayed thereby. Heretofore, correction of the time displayed by electronic digital display timepieces has been effected by indexing the count of the divider stage applying timekeeping signals to the digital display element by manually actuating a switch. Another method of correcting the time displayed is to apply an internal clock signal to the divider stage to rapidly advance the count thereof.

Both methods of time correction have been utilized in a timepiece having a plurality of push buttons on the face of the timepiece, a push button being provided for each digit of time to be displayed, such as seconds, minutes and hours. Because such push buttons utilize considerable space on the watch face, and further because such push buttons render it more difficult to maintain a wristwatch waterproof, such wristwatch push button correction arrangements have been less than completely satisfactory.

An alternate approach has been the use of the correction crown to achieve correction of the digits of time displayed. Nevertheless, such correction crowns have been suitable only for use with the rapid advance method. Moreover, such correction crown correction devices have not provided reliable time correction due to the awkward handling provided by the small correction crown, and the difficulty in obtaining the exact correction required.

SUMMARY OF THE INVENTION

Generally speaking, in accordance with the invention, an improved electronic digital display wristwatch adapted to effect correction of the time displayed is provided. The wristwatch comprises a divider circuit including a plurality of divider stages adapted to produce timekeeping signals in response to a high frequency time standard signal. A plurality of display means are adapted to receive the timekeeping signals and display time in response thereto. A correction circuit assembly is coupled to the respective plurality of divider stages, the correction circuit assembly including a manually operated member displaceable in a first and second direction, displacement of the member in a first direction effecting selection of a divider stage to be corrected, and displacement of the member in the other direction effecting correction of the divider stages selected by the first mentioned displacement.

Accordingly, it is an object of this invention to provide improved correction to an electronic digital display electronic wristwatch.

A further object of this invention is to provide an electronic digital display wristwatch having correction of each of the digits of time displayed effected by operation of a correction crown.

Still another object of this invention is to provide simple, reliable, and accurate correction of an electronic digital display wristwatch.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

FIGS. 1 and 2 are perspective views of digital display electronic wristwatches constructed in accordance with the prior art;

FIG. 3 is an illustration of the manner in which correction is effected in accordance with a preferred embodiment of the instant invention;

DETAILED DESCRIPTION OF THE PREFERRED EMBODIMENTS

Figure 4:
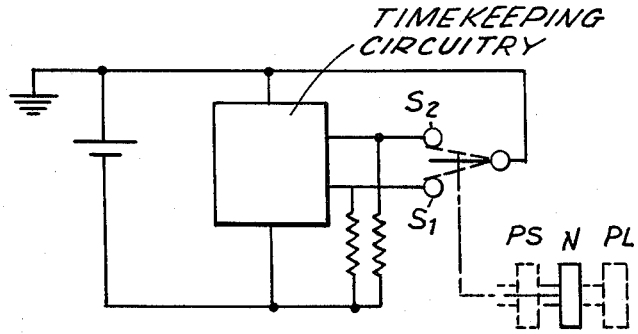
FIG. 4 is a circuit diagram of the manner in which the correction crown actuates the divider circuit in accordance with the instant invention.

Reference is now made to FIG. 1, wherein a perspective view of a digital display electronic wristwatch constructed in accordance with the prior art is depicted. Hours, minutes, and seconds correction switches 1, 2 and 3 are respectively disposed on the front of the wristwatch. A locking crown 4 is disposed on the side of the wristwatch and operates as a locking switch. Correction of the time displayed is effected by pulling out locking switch 4 to thereby render correction by switches 1, 2, and 3 possible. Thereafter, actuation of the hours, minutes or seconds switches 1, 2 and 3 effects correction of the display elements displaying such units of time. In such a correction arrangement, correction can be achieved either by indexing a count of each divider stage by one for each actuation of the switch, or in the alternative, by applying higher frequency clock signals to the divider stage to effect a rapid advance of the count of the divider stage.

Although the correction arrangement depicted in FIG, 1 provides an accurate and simple method of correction for the operator, the necessity of providing four separate switches renders the manufacture of such time pieces extremely complex and expensive. Moreover, due to the desirability of providing water tight wrist watches, it is preferred that the fewest possible externally operative members be provided on the wristwatch.

Referring now to FIG. 2, still another electronic digital display wristwatch constructed in accordance with the prior art is depicted, wherein time correction is effected by utilizing only a correction crown and eliminating the switches on the face of the wristwatch. Correction is effected by pulling the correction crown 5 out to a position 6 illustrated by dash lines. Hour and/or minute correction is then effected by rotation of the correction crown in a first clockwise rotation or second counterclockwise rotation.

The correction arrangement depicted in FIG. 2 is characterized by the necessity of using internal clock signals to effect correcting of the hour and minute divider stages. Moreover, a very complicated rotary switch mechanism is required to achieve the proper application of signals. Also, the accuracy with which such correction can be made by the operator is diminished by the small size of the correction crown and the sensitivity thereof which exposes the time piece to the likelihood of inadvertent rotation in the wrong direction and hence the inadvertent changing of the count of the divider stages not requiring correction.

Reference is now made to FIG. 3 wherein the operation of the instant invention, which is characterized by the provision of time correction utilizing a single correction crown is illustrated. The correction crown has three positions, a first normal position N, a pull position PL, and a push position PS, the correction crown being automatically returned to the N position after displacement to the push and/or pull positions. During normal operation of the timepiece, the correction crown remains at the N position and the display remains in the state 7. In order to effect selective correction of the digits of time displayed by the timepiece, the corrections crown is pulled to the PL position, which selects the seconds digits to be corrected. The selection of the seconds digit causes the seconds digit to flicker as is depicted in state 8. The winding crown having been automatically returned to the normal position is thereafter pushed, and for each pushing of the correction crown to the PS position, the count of the seconds display is indexed by one.

Thereafter, the corrections crown is pulled to the PL position, thereby selecting the minutes display for correction, the minutes display being flickered thereby. Pushing of the correction crown thereafter effects an indexing of the minutes display, with the pulling and pushing of the correction crown thereafter effecting correction of the hours display in the same manner discussed above with respect to the seconds and minutes display. Finally, after the hours display is selected, the next pull of the correction crown once more places the display in the locked condition whereafter pushing will not effect correction of any of the time digits displayed.

Referring now to FIG. 4, the relationship between the switch terminals $S_1$ and $S_2$, and the manner in which same are contacted by the pushing and pulling of the correction crown in the manner depicted in FIG. 3 is illustrated. When the winding crown is at the normal position N, terminals $S_1$ and $S_2$ are referenced to the negative potential of a voltage source through the resisters in common therewith. However, when the winding crown is pulled to position PL, terminal $S_1$ is referenced to the positive potential of the voltage source through a moveable member secured to the winding crown. Similarly, when the winding crown is pushed to the position PS, terminal $S_2$ is referenced to the positive potential by the same moveable member engaged to the winding crown.

Figure 5:
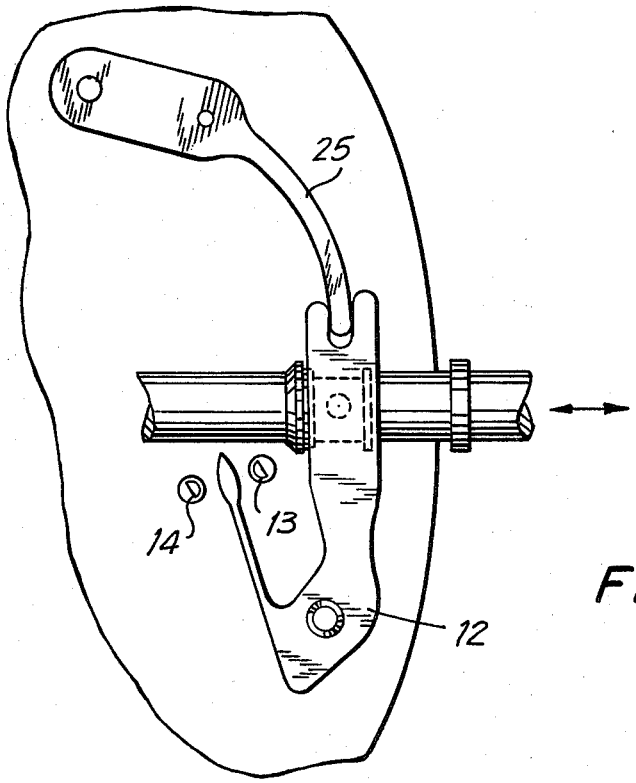
FIG. 5 is a partial elevated view of the correction crown mechanism constructed in accordance with the instant invention.

As depicted in FIG. 5, the moveable member 12 mounted to the winding crown is pivotally mounted to the watch case and is automatically positioned at the N position by a resilient member 25. As indicated by the arrows in FIG. 5, pulling of the winding crown effects a clockwise pivoting of moveable member 12 into contact with terminal 13 which corresponds to terminal $S_1$. Pushing of the winding crown into the wristwatch effects a counterclockwise pivoting of the moveable member 12 into contact with terminal 14, which corresponds to switch terminal $S_2$.

Figure 6:
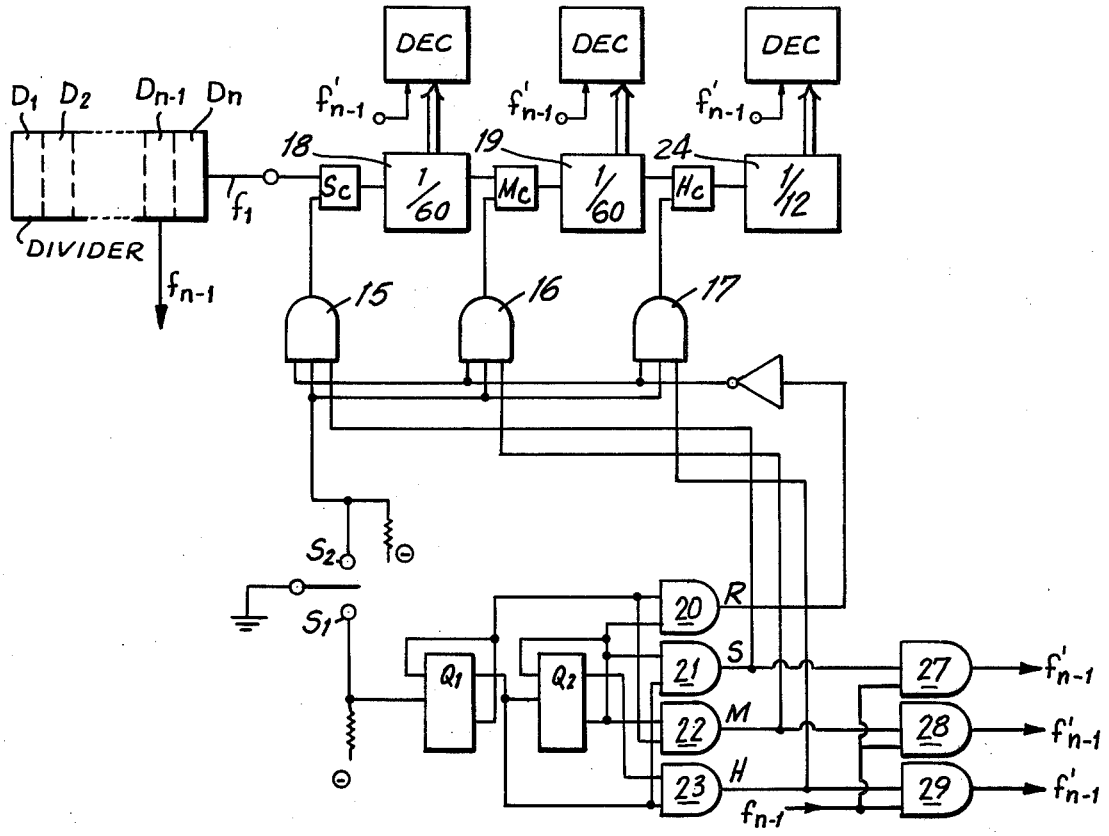
FIG. 6 is a block circuit diagram of the correction circuit adapted to achieve correction of the digital time displayed in accordance with the sequence illustrated in FIG. 3.

Accordingly, to coupling terminals $S_1$ and $S_2$ to the correction circuitry depicted in FIG. 6, correction of the digital time displayed can be effected by utilizing the winding crown to select the digit to be corrected, and then effect such correction of the digit selected. For purposes of simplifying the illustration in FIG. 6, the oscillator circuit and display elements have been omitted. Moreover, the divider circuit including divider stages $D_1$ through $D_n$ for producing a one second signal $f_1$ is depicted merely to illustrate the source of a high frequency signal from higher frequency divider stage $D_{n-1}$ to be used to effect flickering of the digit of time selected for correction.

The one second signal $f_1$ is applied through a combining circuit $S_c$ to a 1/60 divider stage 18 which divider stage produces seconds timekeeping signals for application to a display element through the decoder circuit. Additionally, an output signals having a period of 1 minute from the 1/60 divider stage 18 is applied through combining circuit $M_c$ to 1/60 divider stage 19, which divider stage produces minute timekeeping signals and applies same to the decoder circuit, and additionally applies a signal having a 1 hour period through combining circuit $H_c$ to the 1/12 divider stage 24 for producing hour timekeeping signals. The combining circuits $S_c$ $M_c$ and $H_c$ are well known combining circuits, such as an EXCLUSIVE OR gate, of the type adapted to add an additional correction pulse to the timekeeping signal applied to the divider stage by next-previous divider stage to effect an indexing by one of the count thereof. A counter circuit including flip-flops $Q_1$ and $Q_2$ are coupled to terminal $S_1$. As illustrated in the table depicted in FIG. 6, the flip-flops $Q_1$ and $Q_2$ are adapted to provide a binary count of one to four in response to the contacting of the terminal $S_1$ by the moveable element 12 coupled to the correction crown. AND gates 20 through 23 are coupled to the outputs of the flip-flops and in response to the outputs, $Q_1$ and $Q_2$, produce the outputs R,S, M, and H depicted in the table in FIG. 6. AND gate 20 is coupled through an inverter circuit to a first input of AND gates 15, 16 and 17. Accordingly, when the output of AND gate 20 is positive or 1, each of the AND gates 15, 16 and 17 remain closed leaving the timekeeping operation of the divider circuit and the counting of the divider stages uninterrupted. However, upon pulling the correction crown outward to position PL, the moveable element 12 contacts terminal $S_1$ and the count of the flip-flops is increased by one to thereby change the output of the AND gate 20 to zero, and the output of the AND gate 21 to a positive or 1 potential. The inverter circuit causes the low potential applied thereto to be applied as a positive input to each of the AND gates 15, 16 and 17. Additionally, the output S of AND gate 21 is coupled to the input of AND gate 15 to thereby provide a further positive potential thereto. The output of AND gates 22 and 23 remains at a zero potential and hence insures that gate 16 and 17 remain closed.

Thereafter, pushing of the correction crown effects a contacting of terminal $S_2$ by the moving member 12 to thereby apply a positive potential to the AND gates 15, 16 and 17. Nevertheless, AND gates 16 and 17 remain closed because of the 0 state of the AND gates 22 and 23. On the other hand, application of a 1 or positive pulse to the input of the AND gate 15, coincident with the other two input terminals being at a 1 state, produces a positive input pulse to the combining circuit $S_c$ to thereby index the count of the divider stage 18 producing the seconds timekeeping signal to be indexed by one. Each further pushing of the correction crown effects a further indexing of the divider stage 18 by one. Correction of the minutes and hours is achieved in the same manner as described above.

Additionally, the state of the signal produced by AND gates 21 through 23 are utilized to gate the high frequency signal $F_{n-1}$ to the input of the decoder circuit to effect the flickering of the display element corresponding thereto. For the example explained above with respect to the correction of the second display, the input to AND gate 27 is positive or 1 and the inputs M and H to AND gates 28 and 29 are at a low potential or 0. Accordingly, only AND gate 27 is adapted to apply a higher frequency signal $F'_{n-1}$ to the seconds decoder in response to the intermediate frequency signal $F_{n-1}$ applied thereto.

From the foregoing, it is noted that applicant's invention is characterized by the provision of a time correction assembly for a digital display electronic wristwatch having a correction crown mechanism similar in appearance to a conventional mechanical wristwatch. It is noted that the time correction assembly disclosed herein is particularly suitable for effecting mass production of an electronic digital wristwatch. Moreover, by including the flickering feature disclosed herein, the operator is clearly able to observe the digit to be corrected to thereby provide a more accurate and simplified correction.

It is noted that although the preferred embodiment of the instant invention is described with reference to a digital wristwatch having a display or hours, minutes and seconds, the number of digits to be corrected can be reduced to eliminate the seconds display, or in the alternative can be increased to provide correction for the display of the day of the week and the monthly date. It is further noted that the instant invention is not limited solely to indexing the count of the divider stages but could also be used with rapid advance clock signals. Finally, the improved correction assembly disclosed herein is equally suitable for use in digital display wristwatches having liquid crystal, light emitting diode or other well known selectively energizable display elements.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic wristwatch having divider means including a plurality of divider stages adapted to produce timekeeping signals in response to a high frequency time standard signal, and a plurality of display means adapted to receive said timekeeping signals and display time in response thereto, the improvement comprising correction means coupled to at least two of said respective plurality of divider stages, said correction means including a manually operated member displaceable in a first and second direction, each displacement of said member in a first direction sequentially selecting a different divider stage to be corrected, and displacement of said member in the other direction effecting correction of said divider stage last selected by each said first mentioned displacement.

2. An electronic wristwatch as claimed in claim 1, wherein said manually operated member is a correction crown.

3. An electronic wristwatch as claimed in claim 2, wherein said first and second directions are axial with respect to said correction crown.

4. An electronic wristwatch as claimed in claim 3, and including means for biasing said correction crown in a non-displaced position whereby said correction crown is automatically returned to said non-displaced position after displacment thereof in said first or second directions.

5. An electronic wristwatch as claimed in claim 3, wherein said correction means includes a first terminal adapted to be contacted in response to displacement of said correction crown in said first direction, and selection means intermediate said first terminal and at least two divider stages to be corrected for sequentially selecting one of said divider stages to be corrected in response to each contact of said terminal.

6. An electronic wristwatch as claimed in claim 5, and including a second terminal adapted to be contacted in response to displacement of said correction crown in said other direction, said second terminal being coupled through said selection means to said divider stages to be corrected to effect, in response to each contacting of said second terminal, the application of a correction signal to said divider stage selected by said selection means.

7. An electronic wristwatch as claimed in claim 6, wherein said selection means includes digital counting circuit means coupled to said first terminal and adapted to repeatedly count to the number of said divider stages to be corrected plus one additional count, in response to each contacting of said first terminal said additional count disposing said selection means to prevent the application of a correction signal to each of said plurality of divider stages if said correction crown is thereafter displaced in said other direction to contact said second terminal.

8. An electronic wristwatch as claimed in claim 7, wherein said selection means intermediate said first and second terminals includes a logic gate coupled to each of said plurality of divider stages, said second terminal being coupled to the input of each of said logic gates, said counting circuit being coupled to another input of each of said logic gates, and a combining circuit intermediate the output of each logic gate and the divider stage to be corrected.

9. An electronic wristwatch as claimed in claim 3, wherein said manually operated correction means also includes a pivotally disposed element secured to said correction crown, said element being pivoted in a first rotational direction in response to displacement of said correction crown in said first longitudinal direction, said pivotal member being adapted to be pivoted in said other rotational direction in response to displacement of said correction crown in the other longitudinal direction, first and second contact terminals adapted to be contacted by said respective pivoting of said pivotal member, and selection circuit means for coupling said first and second contact terminals to said plurality of divider stages to be corrected.

10. An electronic wristwatch as claimed in claim 9, and including resilient spring means adapted to bias said correction crown to its non-displaced position in the absence of a displacement force applied thereto.

11. An electronic wristwatch as claimed in claim 5, wherein said divider means is adapted to produce a higher frequency signal than said timekeeping signals, and said selecting means includes a flicker means coupled to said plurality of divider stages, said flicker means applying said higher frequency signal to said divider stage to be corrected upon the sequential selection thereof.

12. In an electronic wristwatch having divider means including a plurality of divider stages adapted to produce timekeeping signals in response to a high frequency time standard signal, and a plurality of divider stages adapted to receive said timekeeping signals and display time in response thereto, the improvement comprising correction means coupled to at least two of said respective plurality of divider stages, said correction means including a manually operated member displaceable in a first and second direction, each displacement of said member in a first direction effecting a sequential selection of one of a different divider stage to be corrected and no divider stage to be corrected, and displacement of said member in the other direction when a divider stage to be corrected was selected by said last displacement of said member in a first direction effecting correction of the divider stage last selected.

13. An electronic wristwatch as claimed in claim 12, wherein said correction means includes a first terminal adapted to be contacted in response to displacement of said member in said first direction, and selection means intermediate said first terminal and at least two divider stages to be corrected for sequentially selecting one of said divider stages to be corrected and no divider stage to be corrected in response to each contact of said terminal.

* * * * *